US005536547A

United States Patent [19]

Simpson

[11] Patent Number: 5,536,547

[45] Date of Patent: Jul. 16, 1996

[54] FLOOR COVERINGS

[75] Inventor: Bernard M. Simpson, Newport, United Kingdom

[73] Assignee: BTR plc, London, United Kingdom

[21] Appl. No.: 283,556

[22] Filed: Aug. 1, 1994

[30] Foreign Application Priority Data

Aug. 3, 1993 [GB] United Kingdom ..... 9317565

[51] Int. Cl.[6] ..... A47G 27/02

[52] U.S. Cl. ..... 428/53; 428/54; 428/58; 15/215; 52/177; 52/181

[58] Field of Search ..... 428/53, 54, 58; 15/215, 216, 217; 52/177, 180, 181

[56] References Cited

U.S. PATENT DOCUMENTS 3,038,190 6/1962 Radvanyi ..... 15/215

FOREIGN PATENT DOCUMENTS 1057374 3/1954 France .
1211755 3/1960 France .
4044735 2/1992 Japan .
1605028 12/1981 United Kingdom ..... 15/217
2258624 2/1993 United Kingdom .
2268058 1/1994 United Kingdom .

*Primary Examiner*—Alexander S. Thomas
*Attorney, Agent, or Firm*—Watson Cole Stevens Davis

[57] ABSTRACT

A floor covering suitable as an entrance mat comprises a plurality of tread strips of substantially resilient and flexible material, each tread strip having a wear layer of fibrous or fibrous like material whereby said tread strips provide a fibrous tread surface, and a plurality of spacer strips of substantially rigid material arranged interposed between the tread strips whereby each successive pair of tread strips is spaced apart by at least two of said spacer strips, and the pluralities of strips being secured together in side by side relationship by connecting means which pass through aligned apertures in the strips, each spacer strip comprising a pair of longitudinally extending and co-planar abutment faces to bear against and provide lateral support to a side face of a tread strip, the maximum spacing of extreme edges of said abutment faces as viewed in cross-section being less than the height of the side face of the tread strip whereby said pairs of spacer strips provide a recess region between a successive pair of tread strips.

16 Claims, 3 Drawing Sheets

FLOOR COVERINGS

BACKGROUND OF THE INVENTION

This invention relates to a floor covering suitable for use as an entrance mat and to a method of manufacture of said floor covering.

A floor covering for use as an entrance mat needs a heavily textured upwardly facing surface having wiper regions to remove dirt and moisture from footwear and recess regions to receive collected dirt pending periodic cleaning. One such type of floor covering in the form of an entree mat is described in assignee's published British Application GB-A-2258624A. The mat comprises a plurality of first strips of substantially rigid material, for example of aluminium or a plastics material such as polyvinyl chloride or polypropylene, and a plurality Of second strips of substantially resilient and flexible material such as natural or synthetic rubber which support a fibrous tread surface, the second strips being interposed alternately between the first strips and the first and second strips being secured together in side-by-side relationship by means of one or more connecting elements, such as wires, which pass through aligned apertures in the first and second strips.

In the aforedescribed construction the fibrous tread surfaces of the second strips serve primarily as wiper regions to support footwear passing thereover and perform a cleaning action whereas the recess regions provided by the first strips between respective neighbouring pairs of second strips serve as collector grooves in which dirt may gather for subsequent removal during a mat cleaning operation.

Commonly the first, substantially rigid, strips are of an H-shape in cross-section with the cross piece of the H, in use, lying vertically in the direction of the thickness of the matting. Said cross piece is provided with apertures through which the connecting elements pass, and the edges of the side pieces of the H formation abut adjacent flexible second strips. Alternatively they are commonly of half an H shape, i.e. a C type shape.

Conventionally each said second strip has an embedded reinforcement of one or more layers of fabric arranged to lie substantially transverse to the plane of the mat and the surface of the rubber or like substantially resilient material is removed from a face of the strip which is to define the tread surface so as to expose the fibres and provide a fibrous tread surface. The embedded reinforcement provides the strip with a good degree of stiffness so that it resists deformation when subject to load.

The resulting mat with a fibrous tread surface as described in the preceding paragraph is found to exhibit excellent wear characteristics even in conditions of arduous use, and to remain effective in providing a cleaning action. However the mat is labour intensive in manufacture.

The construction of the said second strips of embedded reinforcement contributes to excellent wear characteristics and deformation resistance, but that material is expensive.

SUMMARY OF THE INVENTION

An object of the present invention is to provide a floor covering which is relatively economical to construct and is relatively economical in use of materials.

In one of its aspects the present invention provides a floor covering comprising a plurality of tread strips of substantially resilient and flexible material each of which tread strips has a wear layer of fibrous or fibrous like material whereby said tread strips provide a fibrous tread surface, and a plurality of spacer strips of substantially rigid material arranged interposed between the tread strips whereby each successive pair of tread strips is spaced apart by at least two of said spacer strips, and the pluralities of strips being secured together in side by side relationship by connecting means which pass through aligned apertures in the strips, each spacer strip comprising a pair of longitudinally extending and co-planar abutment faces to bear against and provide lateral support to a side face of a tread strip, the maximum spacing of extreme edges of said abutment faces as viewed in cross-section being less than the height of the side face of the tread strip whereby said pairs of spacer strips provide a recess region between a successive pair of tread strips.

The spacer strips may be of a hollow, e.g. tubular shape, as considered in cross-section, and in that case the pair of abutment faces of a strip may be separated by a longitudinally extending slit. That slit may be dimensioned and positioned to allow the connecting means to extend therethrough. Alternatively, the abutment faces may, for example be contiguous, with apertures being provided for the connecting means.

The abutment faces, as viewed in transverse cross-section of a spacer strip, preferably each have a length of at least 15% and more preferably at least 25% of the height of the side face of a tread strip. The abutment faces are able thereby to provide useful lateral support to the relatively substantially resilient and flexible tread strips.

The spacer strips preferably have substantially planar distance faces which are parallel with and spaced from the associated abutment faces and arranged to contact the distance face of another spacer strip of a pair or another spacer element interposed between the two spacer strips of a pair. The distance faces preferably are provided with apertures through which the connecting means may extend.

It is preferred also that the spacer strips each comprise a side face which lies inclined relative to the abutment faces, preferably orientated such that the thickness of the spacer strip reduces, as considered in cross-section, with increasing distance from its abutment faces. That side face preferably is one that faces generally upwardly in use of the floor covering; the spacer strip may have two inclined side faces so that the floor covering is reversible in use. Preferably the spacer strip is of a trapezoidal cross-sectional shape.

Two spacer strips may be arranged directly in contact with one another between a pair of tread strips. They may have planar distance faces spaced from the pairs of abutment faces and may have said spacing determining distance faces directly in contact. Alternatively, auxiliary spacer means may be provided between a pair of tread strips.

The auxiliary spacer means may be longitudinally continuous and be shaped for longitudinally continuous contact with the distance faces. The auxiliary spacer means alternatively may be profiled along its length or may comprise a plurality of discrete spacer elements whereby the floor covering is provided with openings through which dirt or water may pass.

If the auxiliary spacer means comprises discrete spacer elements, said elements may be apertured for location on and support by the connecting means of the floor covering.

The auxiliary spacer means, as viewed in cross-section of the floor covering preferably has a height in the range 40% to 90%, more preferably 50% to 75%, of the height of neighbouring tread strips.

The tread strips may be of a known kind as described in the fifth paragraph of this specification and having an embedded reinforcement. However, the lateral support provided by the abutment faces of the spacer strips of the floor covering of the present invention allow alternatively the use of tread strips of other constructions and which per se are transversely relatively less rigid or resistant to deformation.

The tread strips may, for example, comprise felt material. Two or more layers of felt may be provided in a strip and said layers may lie substantially parallel with the plane of the floor covering, i.e. substantially perpendicular relative to said pairs of abutment faces of the spacer strips.

A felt type tread strip may comprise a first, wear layer of a wear resisting felt material (e.g. polypropylene) and a second, support layer of relatively lower cost material (e.g. reconstituted waste material), the two layers being secured together. The wear strip may be of a sandwich construction comprising two, outer wear layers having a support layer sandwiched therebetween. The first, wear layer(s) may be arranged to lie at least in part above the level of adjacent spacer strips. Preferably the pairs of abutment faces lie in contact predominantly with the support layer and no more than in part with the wear layer(s) of a felt type tread strip.

In a felt type tread strip of two or more layers of material one or more of the layers may be of needle punched material. The layers may be secured together by, for example, needle punching or by use of adhesive.

BRIEF DESCRIPTION OF THE DRAWINGS

Embodiments of the present invention will now be described, by way of example, with reference to the drawings wherein.

DETAILED DESCRIPTION OF A PREFERRED EMBODIMENT

Figure 1:
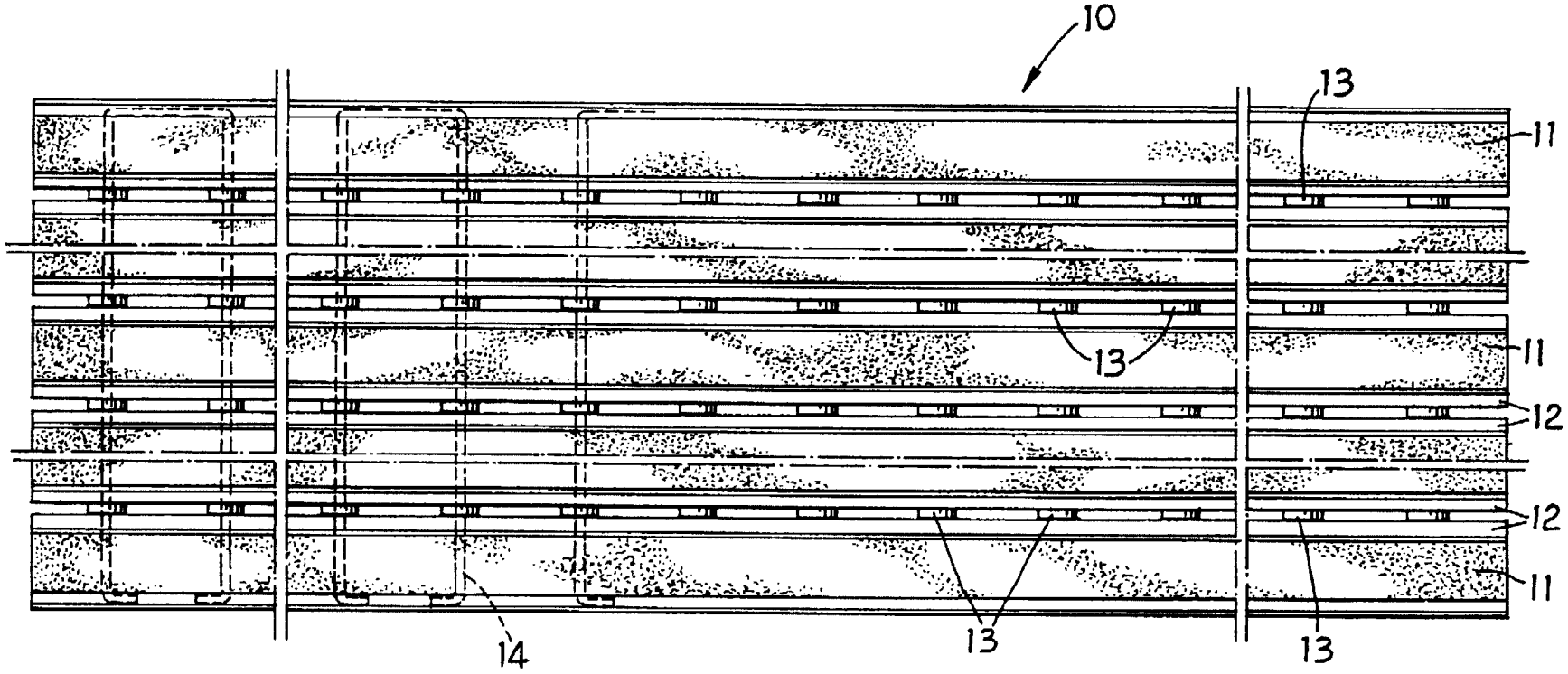
FIG. 1 is a plan view of an entree mat of the invention.
Figure 2:
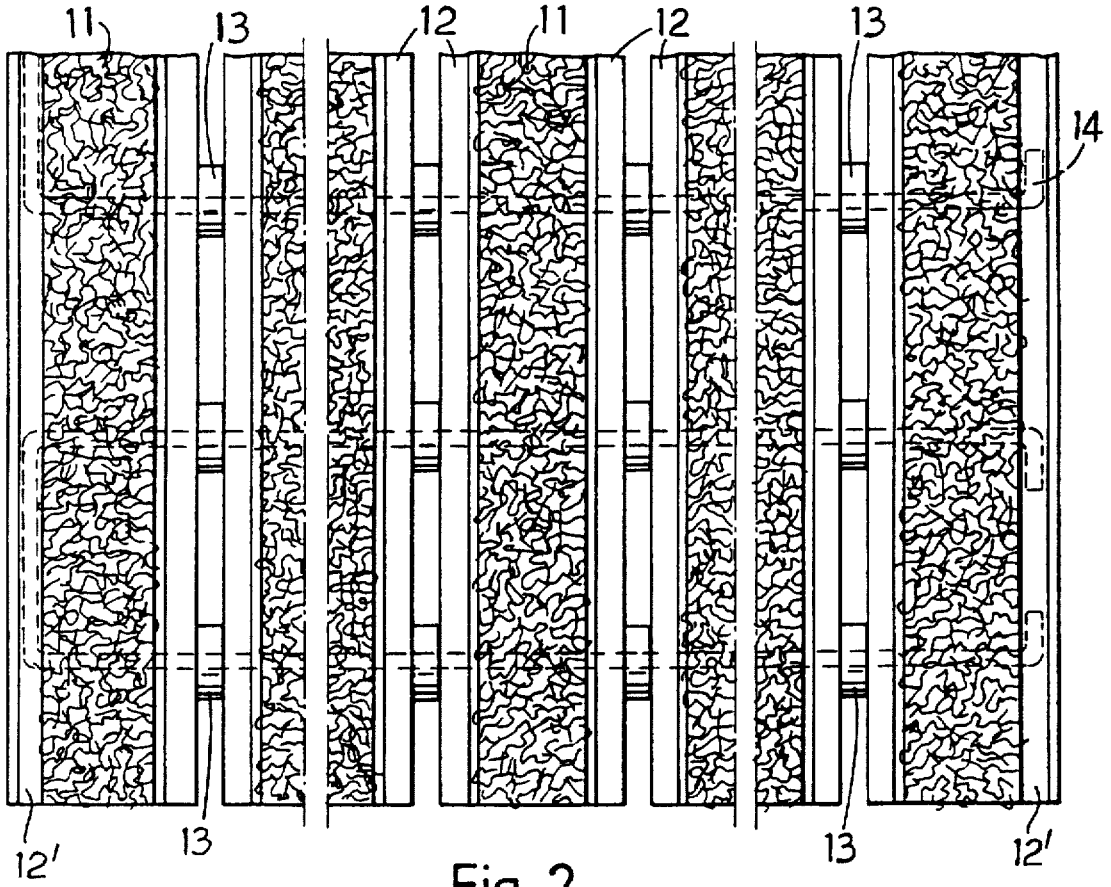
FIG. 2 shows part of FIG. 1 in greater detail.

A floor covering for use as an entrance mat 10 comprises a plurality of relatively substantially resilient and flexible tread strips 11 and a plurality of relatively substantially rigid spacer strips 12 arranged with neighbouring pairs of tread strips each spaced by a pair of spacer strips and the spacer strips of a pair being spaced by a plurality of spacer elements in the form of discs 13.

The assembly of strips 11,12 and discs 13 are held together against transverse separation by means of transversely extending high tensile steel connecting wires.

Each tread strip 11 is a sandwich of three layers of felt. Each strip has two outer, wear layers 15 (see FIG. 3) of polypropylene and a central support layer 16 of reconstituted waste or other low cost material in felt form. The three layers of felt are united by needle punching. The central layer is punched at intervals along its length to provide apertures 17 which extend transversely of the strip, in a direction parallel with the planes of the wear layers 15, for passage of the connection wires through the strip.

Figure 3:
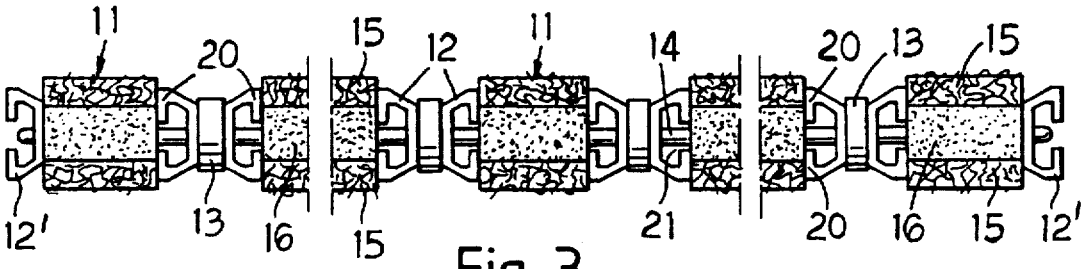
FIG. 3 is an end view of FIG. 2.
Figure 4:
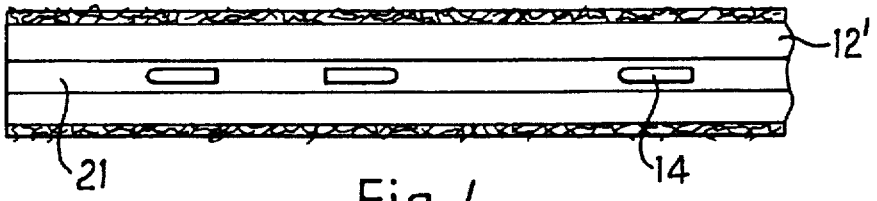
FIG. 4 is a side view of FIG. 2.

The upper and lower outer wear layers 15 each have a thickness of approximately 25% of the thickness, i.e. height, of the strip as viewed in FIG. 3. Thus the layer 16 bas a thickness of approximately 50% of the total thickness.

Each spacer strip 12 is of a hollow, substantially tubular form of extruded aluminium. It comprises a pair of co-planar abutment faces 20 which are separated by a longitudinally extending slit 21. The abutment faces 20 are arranged to abut against a side face of a tread strip. In this embodiment each abutment face, as viewed in FIG. 3, has a height of approximately 30% of the height, i.e. vertical thickness, of a tread strip, and the overall spacing of the extremities of the abutment faces, i.e. the height of the spacer strip in the plane of the abutment faces, is approximately 80% of the height of the tread strips.

Figure 5:
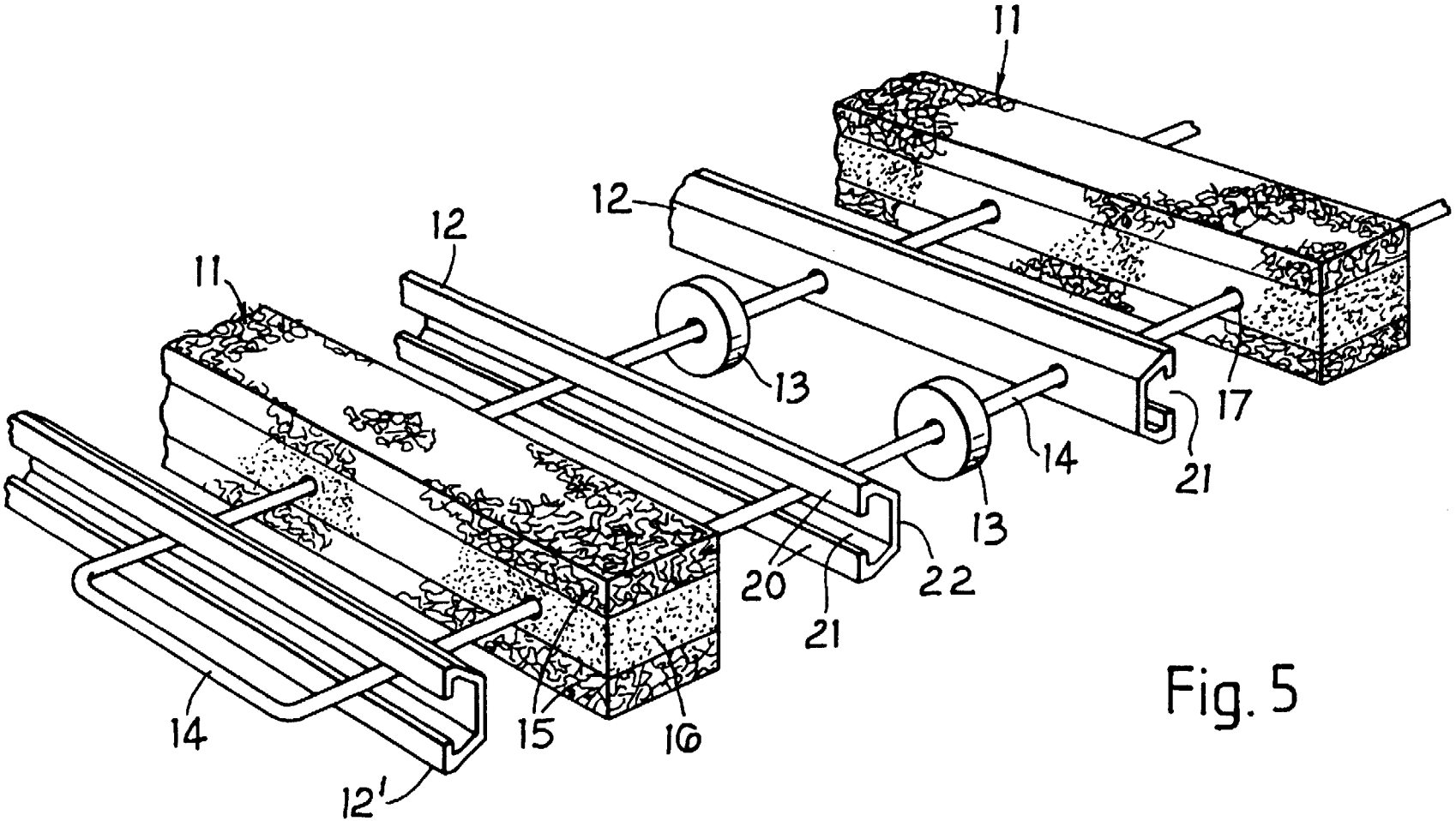
FIG. 5 is an exploded view of part of the entrance mat of FIGS. 1 to 4.

Each spacer strip 12 is of a generally trapezoidal cross-section and at a position remote from the side containing the abutment faces 20 it has a distance face 22 (FIG. 5).

The distance faces 22 of a pair of spacer strips are maintained separated but confronting one another by the aforementioned spacer discs 13.

The outer side faces of the outermost tread strips 11 are abutted by spacer strips 12' of a reverse orientation. That is, the distance face of a strip 12' abuts the central region of a side of a tread strip. By virtue of the reverse orientation the slits 21 in the edge spacer strips 12' allow the hollow region of the strip to accommodate a bent portion of a transverse connecting wire 14.

In the construction shown in FIGS. 1 to 5 the abutment faces 20 of the spacer strips 12 provide good support for the tread strips 11 which therefore can be of relatively low cost material. But the invention envisages that other constructions such as constructions as described in assignee's published British Patent Application No. 2 258 624 A may be used.

What I claim is:

1. A floor covering comprising a plurality of tread strips of substantially resilient and flexible material each of which tread strips has a wear layer of fibrous or fibrous like material whereby said tread strips provide a fibrous tread surface, a plurality of spacer strips of substantially rigid material arranged interposed between the tread strips whereby each successive pair of tread strips is spaced apart by at least two of said spacer strips, and the pluralities of strips being secured together in side by side relationship by connecting means which pass through aligned apertures in the strips, each spacer strip comprising (a) a pair of longitudinally extending and co-planar abutment faces to bear against and provide lateral support to a side face of a tread strip, said abutment faces, as viewed in transverse cross-section of a spacer strip, have a height which is at least 15% of the height of the side face of the tread strip, the maximum spacing of extreme edges of said abutment faces as viewed in cross-section being less than the height of the side face of the tread strip whereby said pairs of spacer strips provide a recess region between a successive pair of tread strips;

(b) spacer strip side faces;

(c) at least one of said spacer strip side faces lying inclined relative to the abutment faces of the strip, and being orientated such that the thickness of the spacer strip reduces, as considered in cross-section, with increasing distance from its abutment faces.

2. A floor covering in accordance with claim 1, wherein said height dimension of said abutment faces is at least 25% of the height of the side face of the tread strip.

3. A floor covering in accordance with claim 1, wherein the spacer strips are of a hollow shape, said hollow shape being peripherally discontinuous in cross section to define a longitudinally extending slit which separates the pair of abutment faces of a spacer strip.

4. A floor covering in accordance with claim 3, wherein the connecting means extends through said slit.

5. A floor covering in accordance with claim 1, wherein each spacer strip has a substantially planar distance face which is parallel with and spaced from the associated pair of abutment faces.

6. A floor covering in accordance with claim 5, wherein each distance face is apertured whereby the connecting means may extend therethrough.

7. A floor covering in accordance with claim 5, wherein two spacer strips between a pair of tread strips are arranged with their respective distance faces in direct contact.

8. A floor covering in accordance with claim 5, wherein the two spacer strips between a pair of tread strips are arranged with their distance faces spaced apart by auxiliary spacer means.

9. A floor covering in accordance with claim 8, wherein the auxiliary spacer means between the distance faces of said two spacer strips are a plurality of discrete spacer elements.

10. A floor covering in accordance with claim 9, wherein said discrete spacer elements are apertured for location on and support by the connecting means.

11. A floor covering in accordance with claim 8, wherein the auxiliary spacer means, as viewed in transverse cross-section of the floor covering, has a height in the range 40% to 90% of the height of the side faces of neighboring tread strips.

12. A floor covering in accordance with claim 11, wherein said height of the auxiliary spacer means is in the range 50% to 75% of said height of neighboring tread strips.

13. A floor covering in accordance with claim 1, wherein the spacer strip is of a trapezoidal cross-sectional shape.

14. A floor covering in accordance with claim 1, wherein a tread strip comprises at least two layers of felt, said layers being orientated to lie substantially perpendicular to the pairs of abutment faces of adjacent spacer strips.

15. A floor covering in accordance with claim 14, wherein said tread strip comprises a wear layer of a wear resisting material and a support layer of a lower cost material, the wear layer being arranged to lie at least in part above the level of adjacent spacer strips.

16. A floor covering in accordance with claim 15, wherein the pairs of abutment faces of spacer strips lie in contact predominantly with the support layer of a tread strip lying between said spacer strips.

* * * * *